US009976318B2

(12) United States Patent
Lynch et al.

(10) Patent No.: US 9,976,318 B2
(45) Date of Patent: May 22, 2018

(54) COLLAPSIBLE SHELTER

(71) Applicant: ARDISAM, INC., Cumberland, WI (US)

(72) Inventors: David John Lynch, Comstock, WI (US); David Lee Nickell, Cumberland, WI (US)

(73) Assignee: ARDISAM, INC., Cumberland, WI (US)

( * ) Notice: Subject to any disclaimer, the term of this patent is extended or adjusted under 35 U.S.C. 154(b) by 0 days. days.

(21) Appl. No.: 15/373,581

(22) Filed: Dec. 9, 2016

(65) Prior Publication Data

US 2017/0167158 A1 Jun. 15, 2017

Related U.S. Application Data

(60) Provisional application No. 62/266,354, filed on Dec. 11, 2015.

(51) Int. Cl.

| | |
|---|---|
| ***E04H 15/44*** | (2006.01) |
| ***E04H 15/40*** | (2006.01) |
| ***E04H 15/56*** | (2006.01) |
| *E04H 15/32* | (2006.01) |

(52) U.S. Cl.

CPC ..... *E04H 15/40* (2013.01); *E04H 15/44* (2013.01); *E04H 15/56* (2013.01); *E04H 15/32* (2013.01)

(58) Field of Classification Search

CPC ..... E04H 15/48; E04H 15/54; E04H 15/44; E04H 15/64; E04H 15/42; E04H 15/56; E04H 15/40; E04H 15/60

USPC ..... 135/135, 137, 147–148, 151, 152, 156, 135/159, 116, 115, 119, 905

See application file for complete search history.

(56) References Cited

U.S. PATENT DOCUMENTS

| | | | | |
|---|---|---|---|---|
| 1,728,356 A * | 9/1929 | Morgan | E04H 15/50 | 135/154 |
| 3,941,140 A * | 3/1976 | Beavers | E04H 15/32 | 135/120.3 |
| 4,285,355 A * | 8/1981 | Lundblade | E04H 15/42 | 135/147 |
| 4,305,414 A * | 12/1981 | Bareis | E04H 15/56 | 135/116 |
| 4,941,499 A * | 7/1990 | Pelsue | E04H 15/42 | 135/125 |
| 7,222,635 B2 * | 5/2007 | Cantwell | E04H 15/54 | 135/115 |
| 7,565,909 B2 * | 7/2009 | Reis | E04H 15/001 | 135/115 |
| 7,665,478 B2 * | 2/2010 | Wehner | A01G 9/16 | 135/115 |

(Continued)

*Primary Examiner* — Winnie Yip
(74) *Attorney, Agent, or Firm* — Fox Rothschild LLP

(57) ABSTRACT

A collapsible shelter is provided. The shelter includes a floor having a recessed portion and an elevated portion. The elevated portion includes first fastening means thereon. Four side walls include second fastening means configured to operably couple each of the side walls to the floor by the first fastening means. Each of the side walls including a first plurality of flexible poles coupled thereto and configured to expand the side walls outwardly. A roof includes a plurality of roof panels, each of the panels is coupled to one of the side walls. The roof panels each include a second plurality of flexible poles coupled thereto and configured to expand the roof outwardly.

16 Claims, 24 Drawing Sheets

(56) References Cited

U.S. PATENT DOCUMENTS

| | | | | |
|---|---|---|---|---|
| 8,915,258 | B1 * | 12/2014 | Beam | E04H 15/001 135/117 |
| 9,512,632 | B2 * | 12/2016 | Cook | E04H 15/54 |
| 2006/0243312 | A1 * | 11/2006 | Williamson | E04H 15/44 135/121 |
| 2007/0079860 | A1 * | 4/2007 | Vanderhorst | E04H 15/42 135/156 |

* cited by examiner

COLLAPSIBLE SHELTER

RELATED APPLICATION

This application claims the benefit of U.S. provisional patent application Ser. No. 62/266,354, filed on Dec. 11, 2015; the entirety of which is fully incorporated herein by reference.

FIELD OF THE INVENTION

The present invention relates generally to shelters, such as a tent, used for camping. In particular, the invention relates to a collapsible shelter or tent that can be set up and stored without the need for laborious assembly and/or disassembly.

BACKGROUND OF THE INVENTION

Camping is a popular summer and winter past time and is an activity where a group of persons or an individual is lodged in a tent or tents as a means of shelter from the elements including wind, rain, snow and insects. Typically, a tent includes room sufficient to house one to four, and possibly more, individuals and may also include screens that serve as windows and a zippered panel that serves as the entry way or "door." The large majority of tents are portable and can be transported by the individuals themselves and set-up at different locations. Ideally, when individuals arrive at the campsite the first thing that happens is setting up the tent.

However, the problem with existing tents is that there are many loose parts that need to assembled, which consumes a significant amount time. Additionally, the sheer number of parts needed to assemble the tent make it difficult to keep track of them; thus, tents are frequently assembled incorrectly and the individuals need to start over. During the winter months, the individual assembling the tent will typically remove their gloves to improve dexterity but with gloves removed individuals also find it difficult to assemble the many parts without losing dexterity due to the cold.

Additionally, tents can be hard to clean and difficult to service. Because camping is an outdoor activity, individuals frequently deal with rain, dirt, and other natural and unnatural contaminates. Tents typically have a floor that is permanently fixed to the other parts of the tent skin making cleaning the product difficult, if not impossible. To solve this problem the cumbersome process of shaking or turning the tent inside out to remove the foreign material is utilized. If there is a rip or other damage to the floor, an individual has the option of either trying to repair the floor or scrap the entire tent completely.

Accordingly, there is a need for a tent that can be easily assembled and disassembled, cleaned and serviced.

BRIEF SUMMARY OF THE INVENTION

The problems outlined above are addressed by the collapsible tent in accordance with the invention. The collapsible tent in accordance with the invention provides for a system of poles integrated with fabric panels from which the tent is constructed, such that the tent may be used or stored without laborious assembly or disassembly. The system also reduces the number of components that are required to construct the tent in accordance with the invention. After constructed at the factory, the user only has to pop out the side panels and roof and attach the optional rainfly, if desired. Similarly, when leaving the campsite a user simply detaches the rain fly, pops the side panels in and pulls the roof inwardly/down and the tent collapses. The user can then conveniently roll up the tent and pack it away into a carry case.

The tent includes four side panels and a roof panel. Four elongate members or flexible poles are fixed to the corners of each of the four side panels and the roof panel comprising the tent. A first end of each pole is inserted into a pocket or sleeve formed at the corner on the inside of the side wall or, in the case of the roof panel at the corner on the outside of the roof panel (as the roof poles are positioned on the outside of the roof for reasons that will be disclosed hereinafter in detail). The second opposite end of the poles have a mating portion received by a hub, which is centrally located and affixed to each side wall and roof panel. The flexible poles are configured to expand the side walls outwardly when a user pulls on a pull. The flexible poles attached to the roof panel are configured to expand the roof panel outwardly, i.e. upwardly.

The floor of the tent in accordance with the invention is removably coupled to each side wall by fastening means making it easy to clean and service the different aspects of the tent. This construct also prevents moisture, rain, insects and other creatures from entering through this connection. The floor includes a recessed portion and an elevated portion, the elevated portion includes first fastening means thereon. The four side walls include each include fastening means configured to matingly couple the side walls to the floor.

In another aspect of the invention, the plurality of flexible roof poles include a mating portion at an end thereof configured to mate with the connecting piece of the optional rainfly, as hereinafter disclosed.

The tent in accordance with the invention also includes an optional rainfly removably coupled to the roof panel. The rainfly includes an inner surface and an outer surface and includes four connecting pieces, each of which is inserted into a sleeve or pocket. The sleeves/pockets are typically constructed of fabric and coupled to the inner surface of the rainfly at a perimeter thereof. As previously noted, the roof poles are positioned on the outer surface of the roof and inserted through a sleeve with the second end matingly coupled to a hub. These roof poles thus create the skeleton to which the rainfly may be coupled. The four connecting pieces that are fixed to the rainfly fabric are configured to mate with the first end of each of the four roof poles at a corner grommet. The rainfly also includes an overhang at an end thereof that couples with the side wall panels to create complete protection from the rain.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Figure 1A:
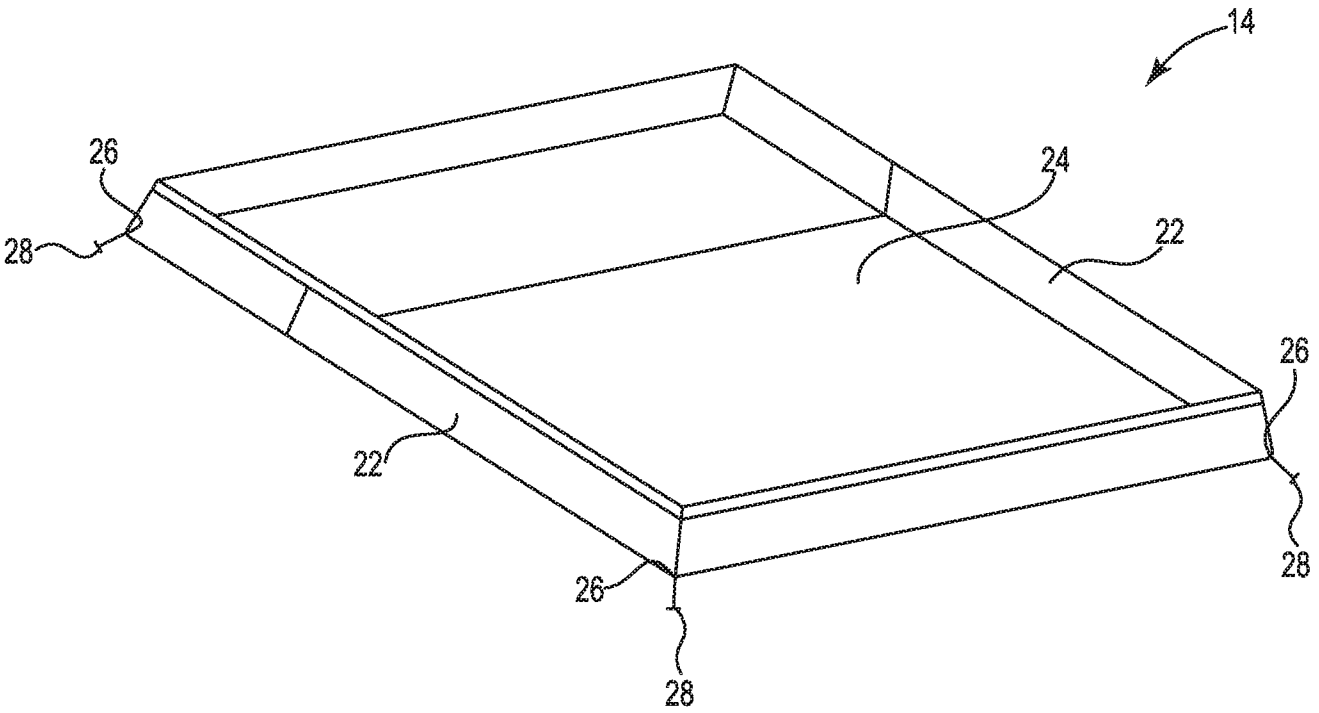
FIG. 1A is a perspective view of the floor of the tent in accordance with the invention.
Figure 1C:
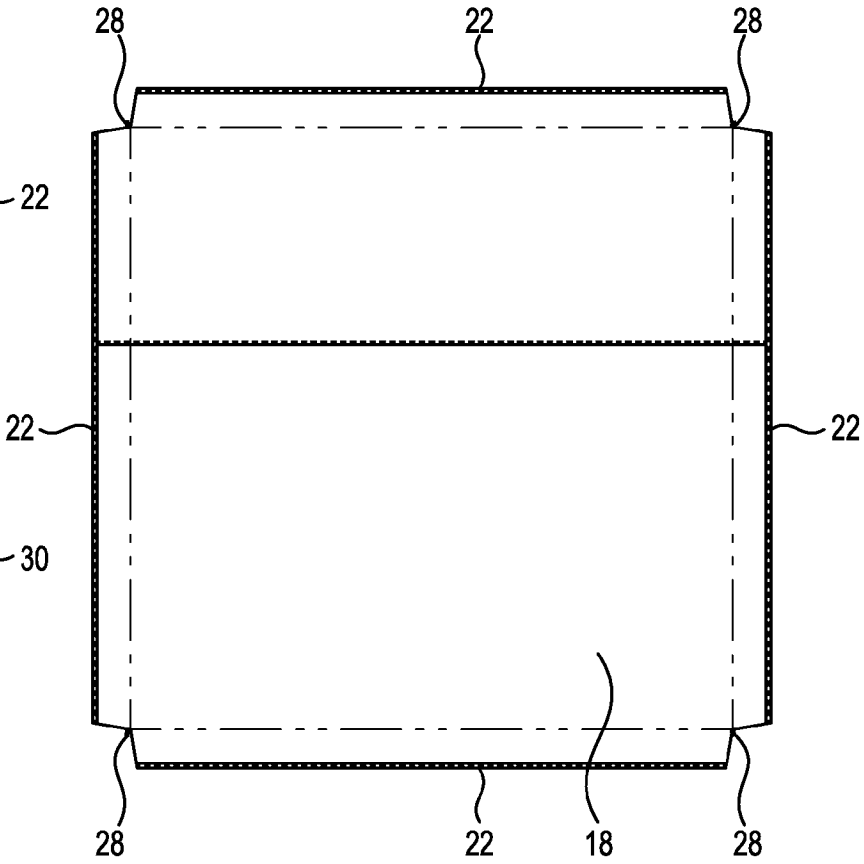
FIG. 1C is a top view of the interior of the floor depicted in FIG. 1.
Figure 1B:
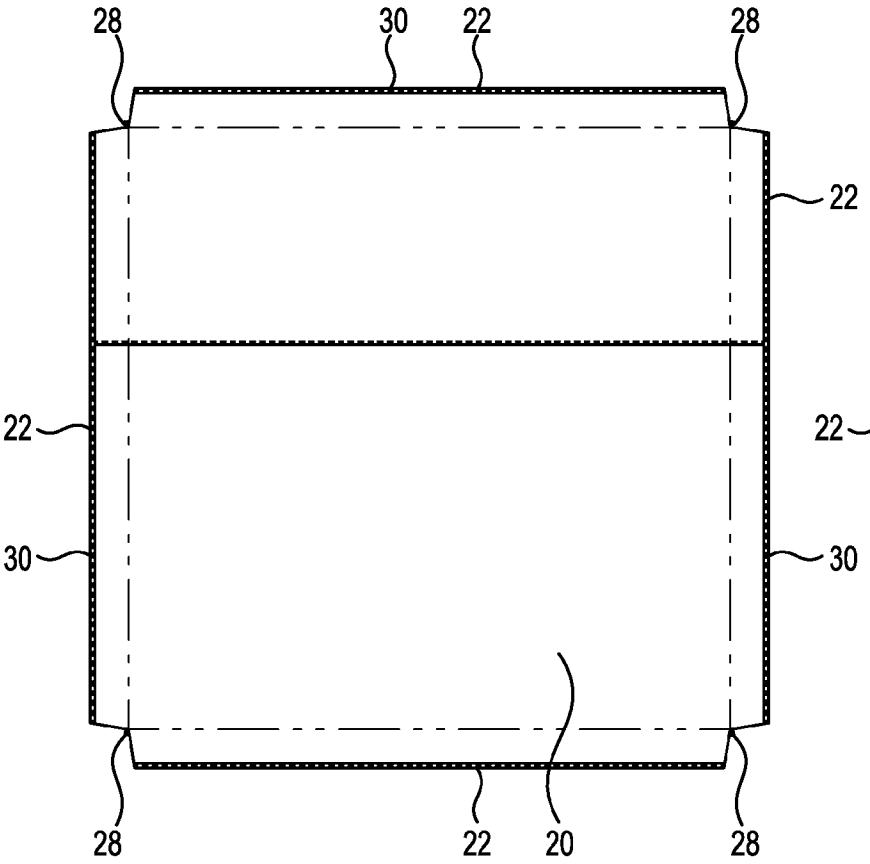
FIG. 1B is a top view of the exterior of the floor depicted in FIG. 1.
Figure 1D:
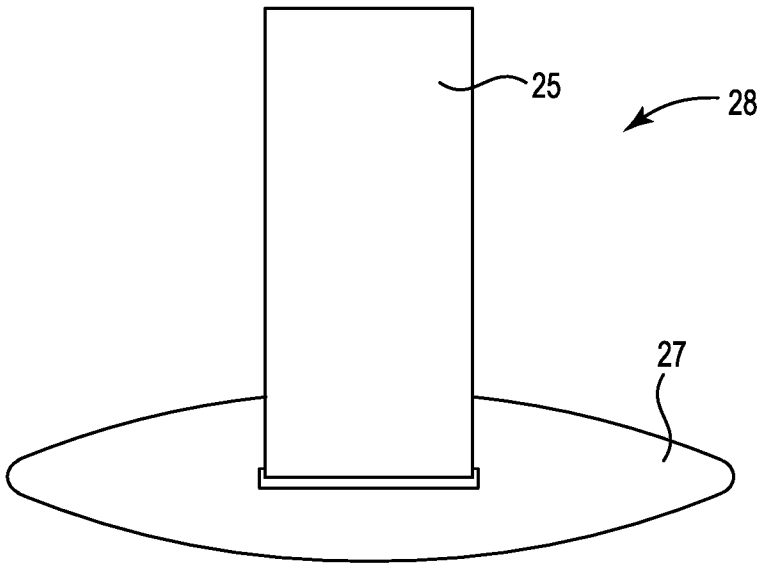
FIG. 1D is a perspective view of a floor tie used to anchor the floor to the tent.
Figure 2A:
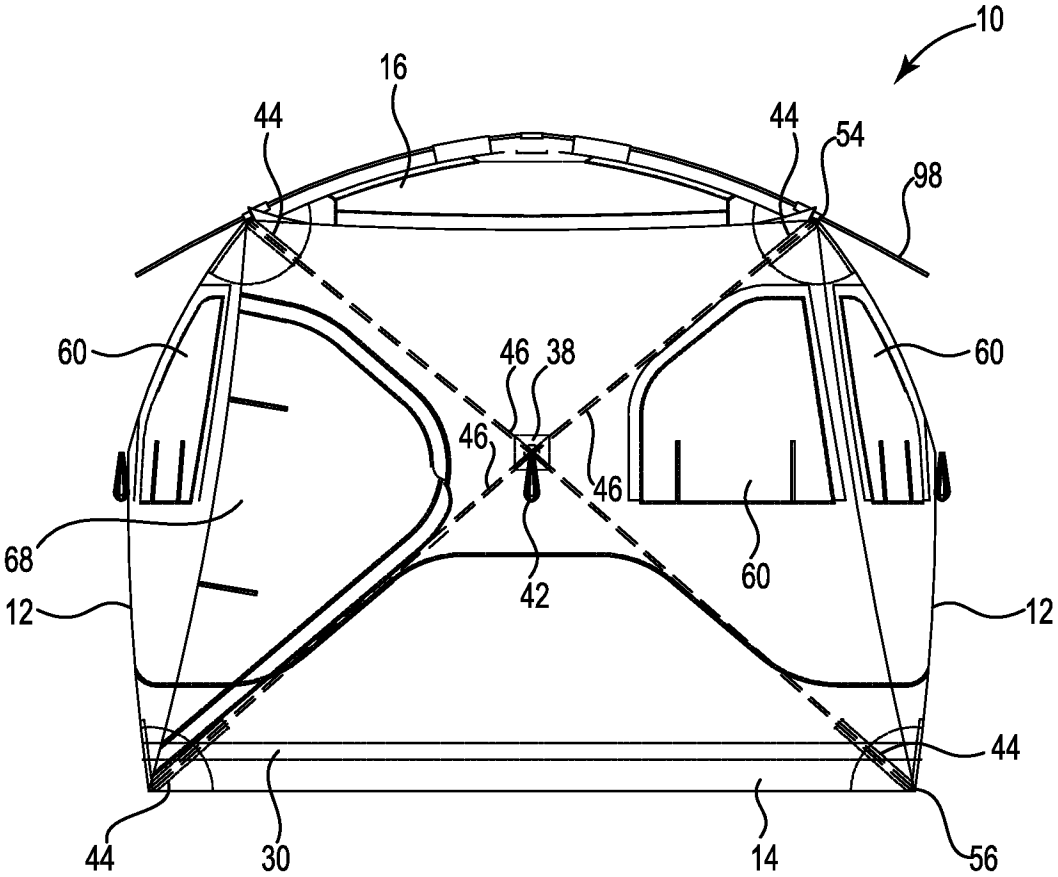
FIG. 2A is an elevational view of the exterior of the tent in accordance with the invention.
Figure 2B:
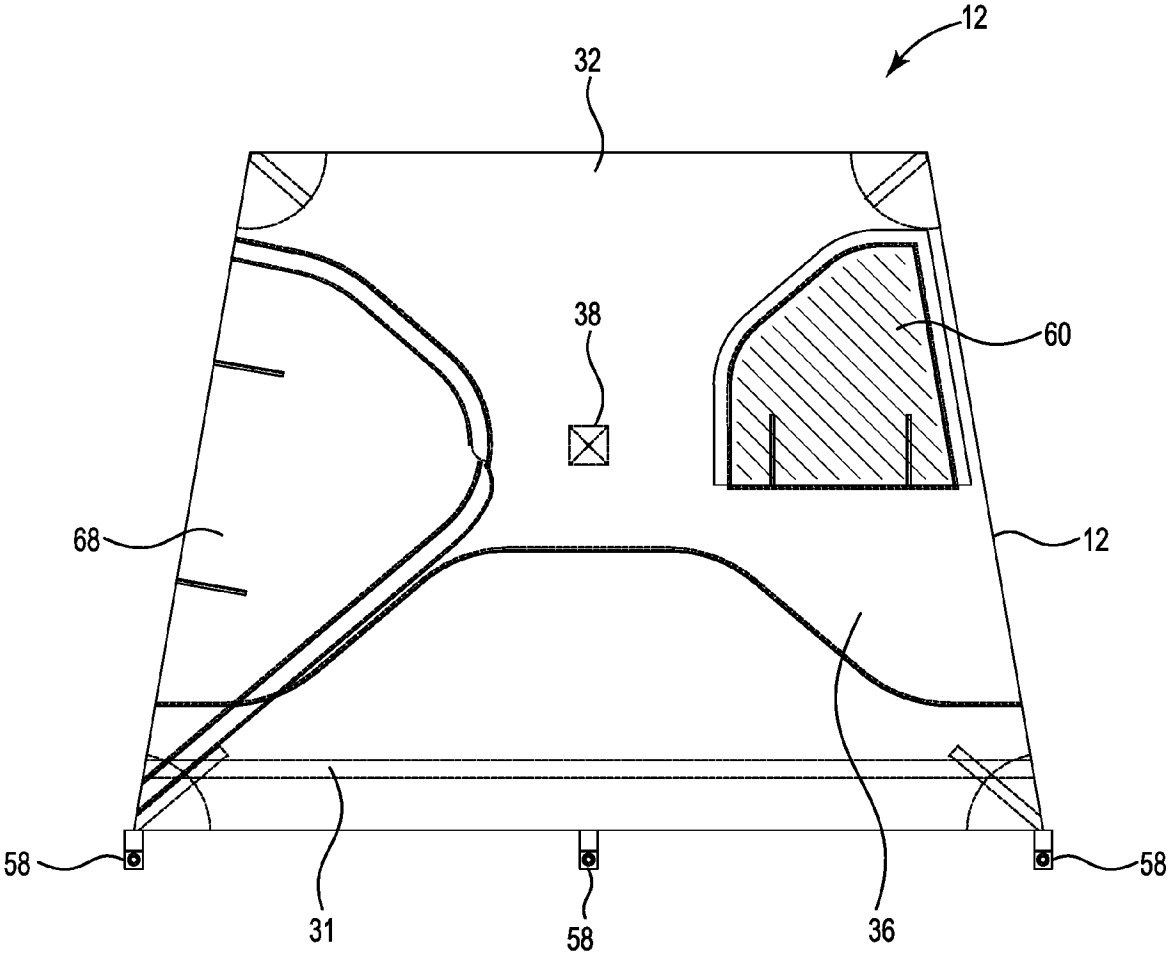
FIG. 2B illustrates the exterior of side walls A and C of the tent in accordance with the invention.
Figure 2C:
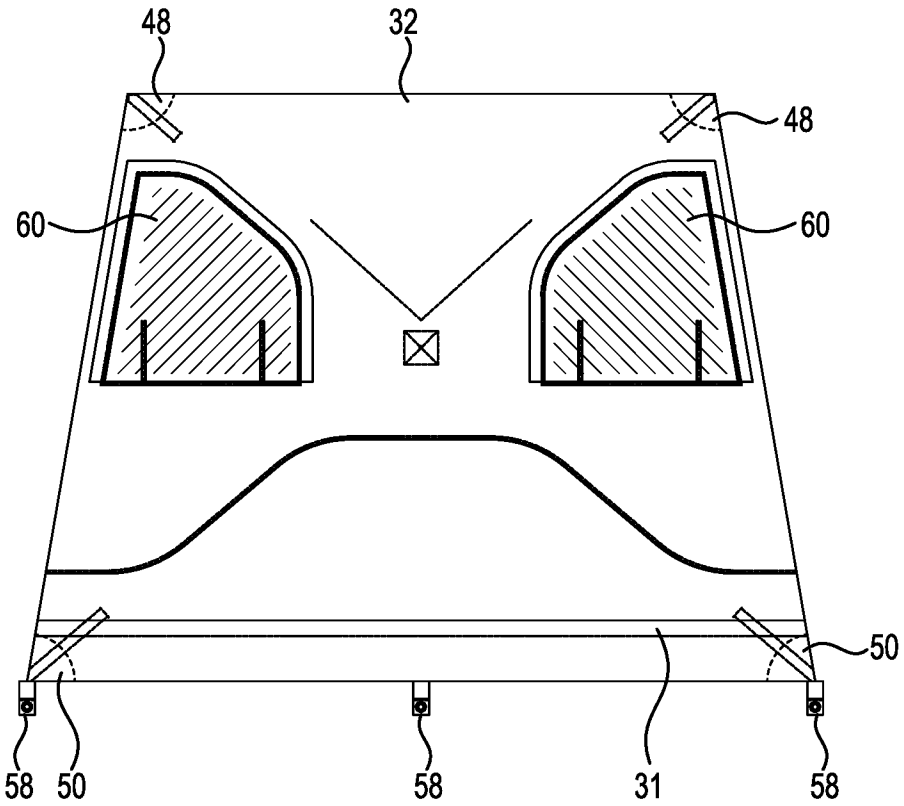
FIG. 2C illustrates the exterior of side walls B and D of the tent in accordance with the invention.
Figure 2D:
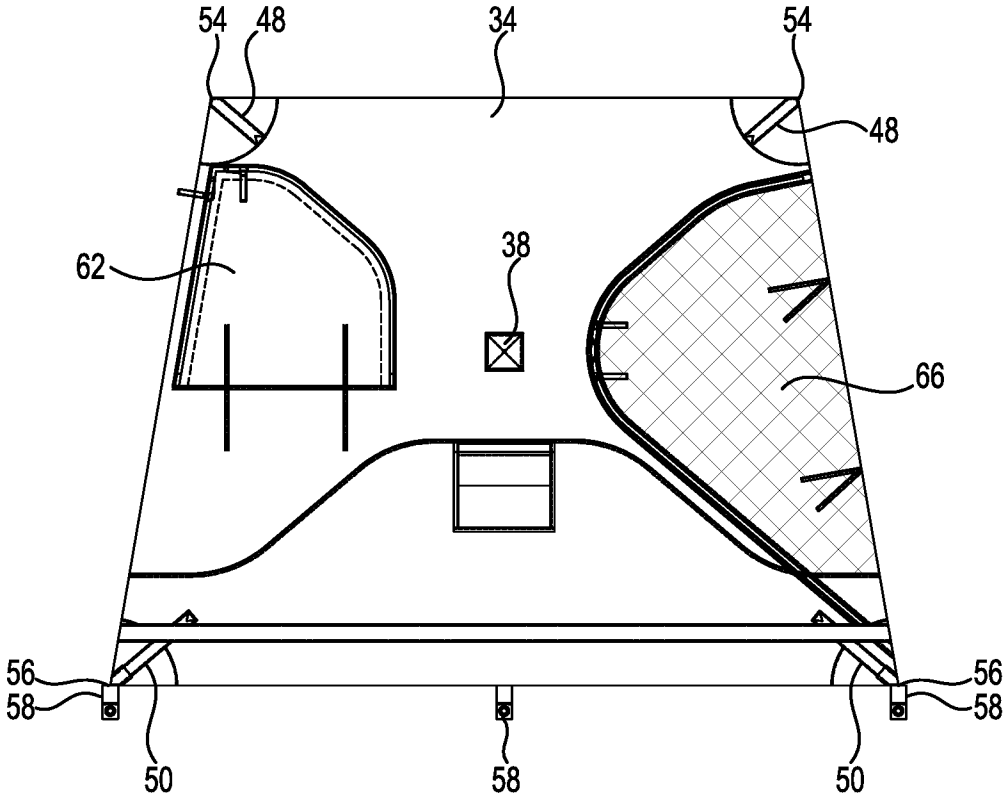
FIG. 2D illustrates the interior of side walls A and C of the tent in accordance with the invention.
Figure 2E:
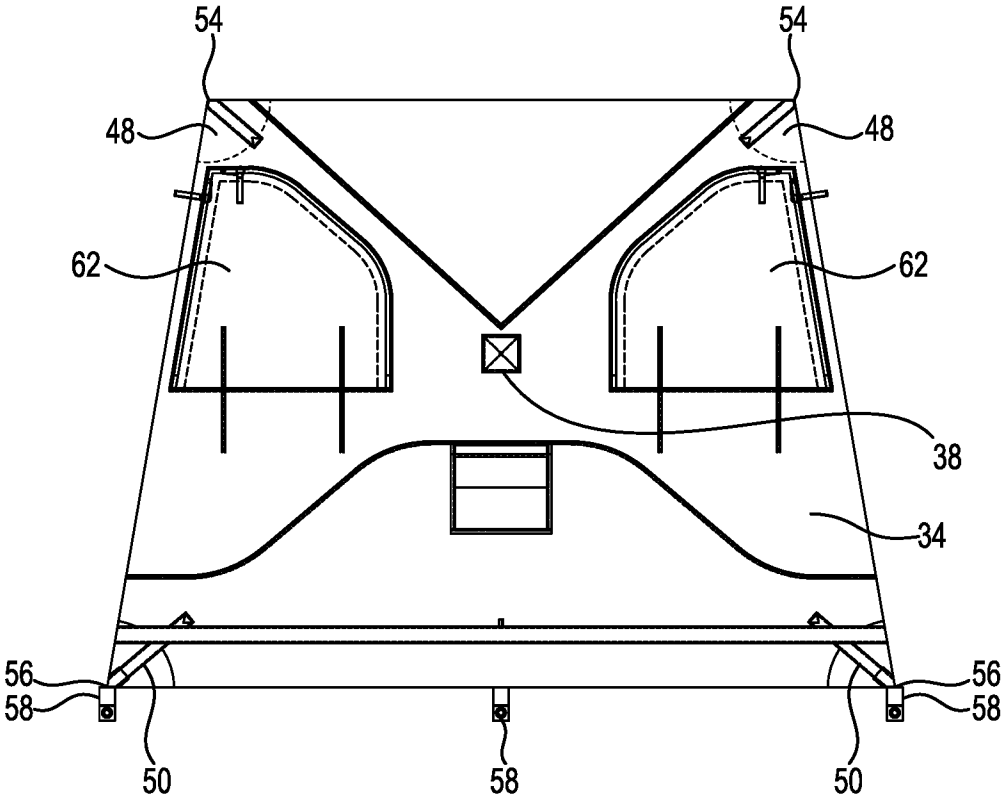
FIG. 2E illustrates the interior of side walls B and D of the tent in accordance with the invention.
Figure 2F:
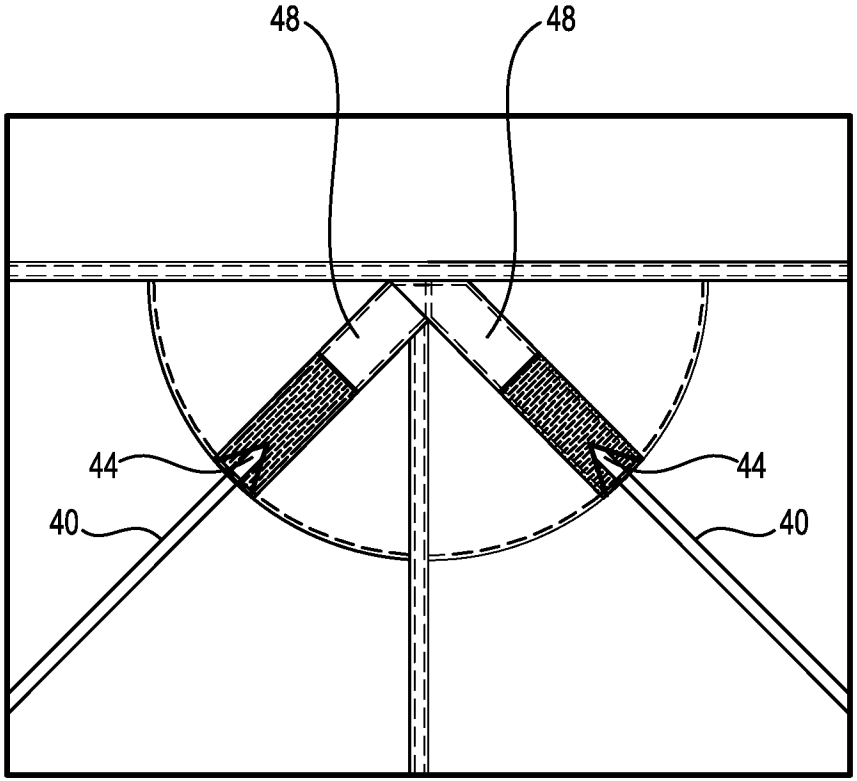
FIG. 2F illustrates the stitched corner upper sleeves/pockets of side walls into which tent poles are inserted.
Figure 2G:
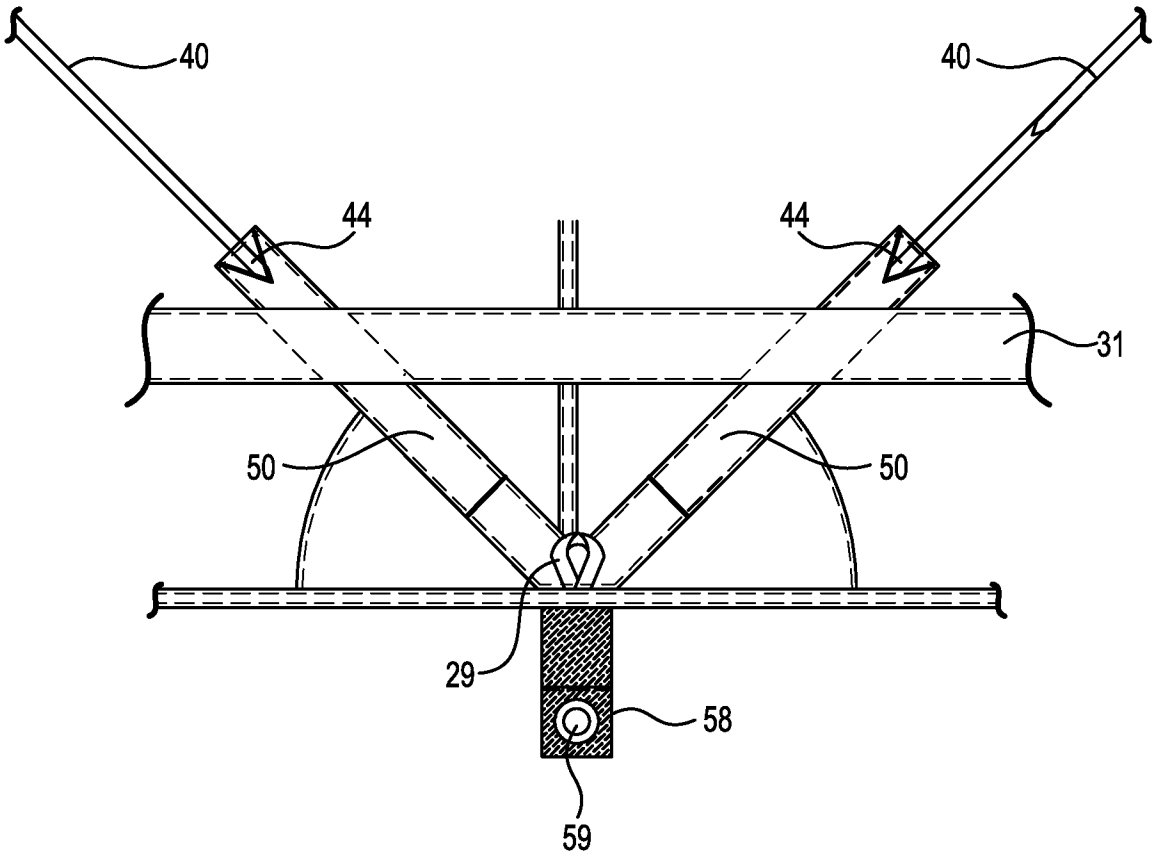
FIG. 2G illustrates the bottom corner of side walls showing sleeves/pockets into which tent poles are inserted and various other components.

Referring now to the FIGS. the tent in accordance with the invention is described. Tent 10 broadly includes four tent side walls or panels 12, floor 14 and roof 16. As best seen in FIGS. 1B and 1C floor 14 includes an interior surface 18 and an exterior surface 20, respectively. Floor 14 includes four side portions 22 that are designed to be sewn together at the corners thereof to form floor 14 such that four side portions 22 are elevated to form a bath-tub like recessed floor portion 24, as best seen in FIG. 1A. Each corner 26 of floor 14 includes a tie 28 coupled thereto, as best seen in FIG. 1D, that is configured to couple floor 14 to side walls 12 at the four corners by looping it through tent floor tie 29, as best seen in FIG. 2G. Tie 28 includes an elastic portion 25 and a toggle portion 27. Toggle portion 27 may be constructed of plastic or other non-rusting materials known to those of skill in the art. There are four tent floor ties 29 that mate with four ties 28. Toggle portion 27 of tie 28 is depicted as being oval but those of skill in the art will appreciate that toggle portion 27 may have any shape. Tent floor tie 29 may comprise a fabric ring-like structure that includes an opening for inserting toggle portion 27 of tie 28 therethrough. Those of skill in the art will also appreciate that tent floor tie 29 may take on other forms, such as oval, square and the like, so long as there is an opening through which tie 28 can be insertably coupled thereto. The coupling of tie 28 to tent floor tie 29 maintains the recessed floor portion 24 tight to the bottom of the tent 10.

Each side portion 22 of floor 14 includes a strip of fastening material 30 on a bottom portion thereof, as best seen in FIGS. 1B and 1C. When side portions 22 are sewn, or otherwise joined, to assume the elevated configuration, as best seen in FIG. 1A, fastening material 30 is positioned along an upper edge thereof. The four tent side walls 12 have a strip of mating fastening material 31 (seen in FIGS. 2B, 2) on a bottom edge that is configured to mate with fastening material 30. It is contemplated that the mating pieces of fastening material 30, 31 comprise Velcro but those of skill in the art will appreciate that any fastening material that is capable of allowing floor 14 to be removably coupled to side walls 12 of tent 10 is within the scope of the invention. When fully assembled the fastening material 30, 31 couples the floor 14 to the side walls 12 and is configured to prevent rain, moisture, insects and other small creatures from entering tent 10.

Thus, as herein described, floor 14 may be coupled to tent side walls 12 by two methods: fastening means 30, 31 and tie 28 coupled to tent floor tie 29.

Referring now to FIGS. 2A-2G the construct of side wall 12 will now be discussed. Each side wall 12 broadly includes panel 32 having interior 34 (FIG. 2D, 2E) and exterior 36 (FIG. 2B, 2C) surfaces, a patch hub 38, and four side wall poles 40. Side wall poles 40 may be constructed of fiberglass or any lightweight material having sufficient strength to support panels 32 while also have sufficient flexibility that they can bend outwardly when the side wall 12 is pulled outwardly. Patch hub 38 is coupled to the interior surface 34 of each panel 32 and positioned approximately at the center and may comprise a heavy-weight fabric that is coupled to the interior surface 34 to prevent wearing on the lighter-weight material used to construct the panel 32 due to the rubbing friction exerted by the metal hub 39. Patch hub 38 may be coupled to the interior surface by any type of coupling such as sewing, adhesives, chemical bonding and like means. A hand-graspable pull 42 is positioned on the exterior surface 36 of panel 32 and coupled to patch hub 38. Preferably such coupling is a sewn coupling but may also include an adhesive or bonded coupling and such other couplings known to those of skill in the art.

Figure 2H:
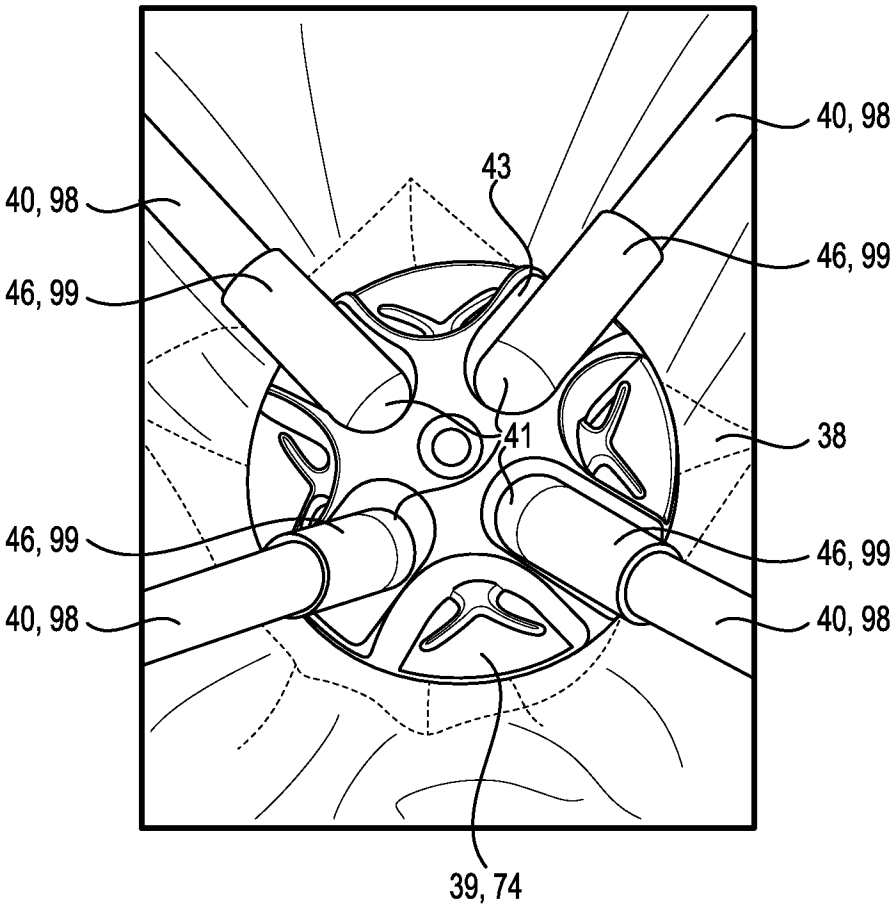
FIG. 2H depicts the metal hub into which roof poles and side wall poles are inserted thereby forming a "ball and socket" joint.
Figure 2I:
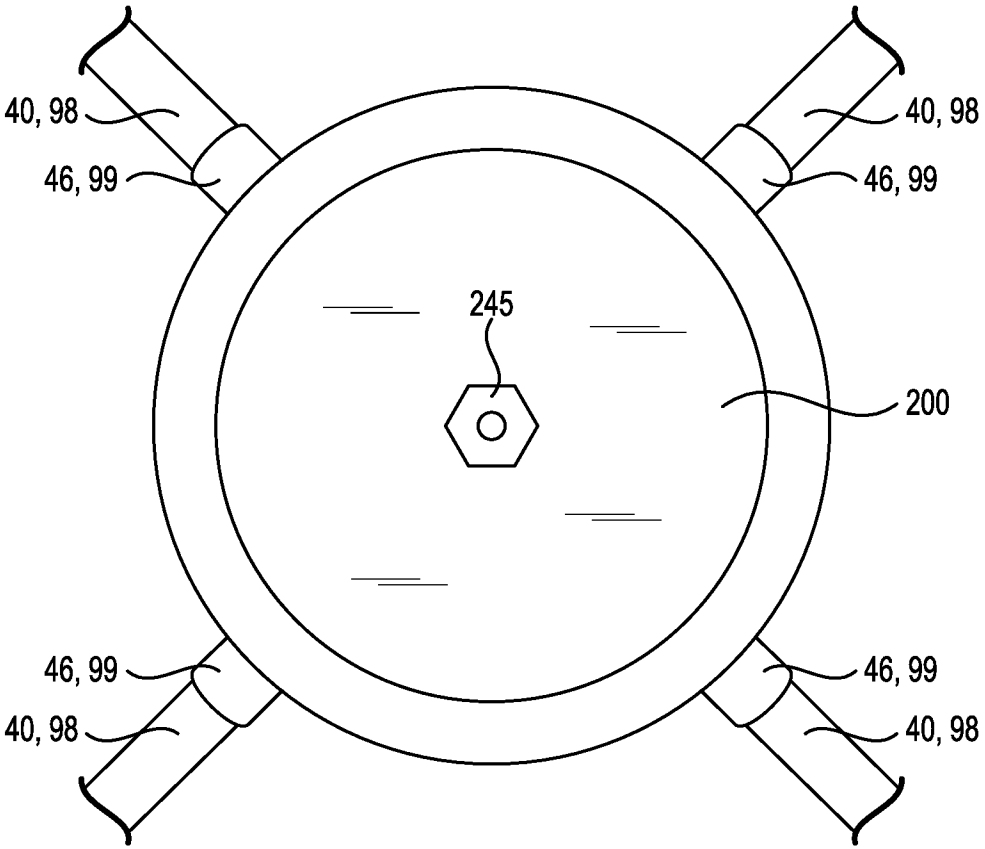
FIG. 2I depicts the cap that covers the metal hub.

Side wall poles 40 include first side wall pole end 44 and second side wall pole end 46. The first end 44 of each side wall pole 40 is anchored at an upper or lower corner 54, 56 of panel 32, as the case may be. Such anchoring in the corner of side wall 12 may include creating upper and lower sleeves 48, 50 that house the first end 44 of side wall pole 40 as best seen in FIGS. 2F and 2G. Upper sleeve 48 is configured to be sewn to the upper corner 54 of panel 32 while lower sleeve 50 is configured to be coupled to lower corner 56 of panel 32. As best seen in FIGS. 2F and 2G, upper and lower sleeves 48, 50 may comprise strips of fabric or other materials known to those of skill in the art that when coupled to panel 32 form a pocket or sleeve 48, 50 that is configured to receive the first end 44 of side wall pole 40. As best seen in FIG. 2H, the second end 46 of side wall pole 40 includes a ball 41. Ball 41 is received into socket 43 of hub 39. Hub 39 includes four sockets 43, each configured to receive the second ball end 41 of side wall pole 40. Hub 39 may comprise plastic or metal and is anchored to patch hub 38. Hub 39 is capped or covered with metal or plastic plate 200, which is secured to hub 39 by hex screw 245 or other types of screws or securing means known to those of skill in the art as seen in FIG. 2I. Those of skill in the art will appreciate that the construct shown in FIGS. 2H and 2I also applies to roof poles 98.

As seen in FIG. 2G, each panel 32 includes one or more straps 58 that are configured to anchor tent 10 to the ground through grommet 59 when fully assembled via commercially available stakes. As seen in FIGS. 2B and 2C, one or more panels 32 may also include screening 60 on the exterior surface 36 thereof. A corresponding cover 62 is positioned on the interior surface 34 as seen in FIGS. 2D and 2E. Cover 62 is configured to cover screening 60 when privacy is desired by an occupant, to protect the interior of tent 10 from rain and/or wind, or when tent 10 is in storage in the disassembled state.

At least two side wall panels 32 include door screening 66 coupled by a zipper to the interior surface 34 and door cover 68 coupled by a zipper to the exterior surface 36 thereof as best seen in FIG. 2B. Thus, each tent includes two entry ways that may be zipped/unzipped independently of each other and be accessed by a user from either the interior or exterior of the tent 10.

Figure 3A:
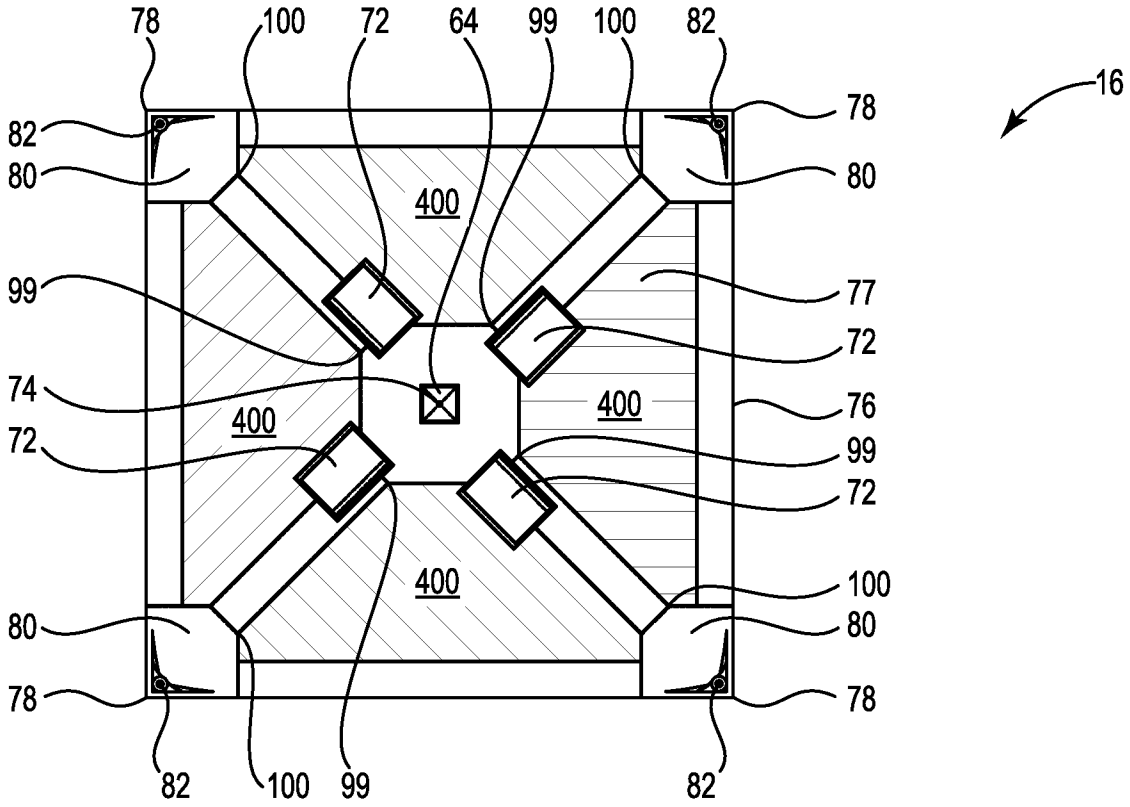
FIG. 3A is a top plan view of the exterior of the roof panel of the tent in accordance with the invention.
Figure 3B:
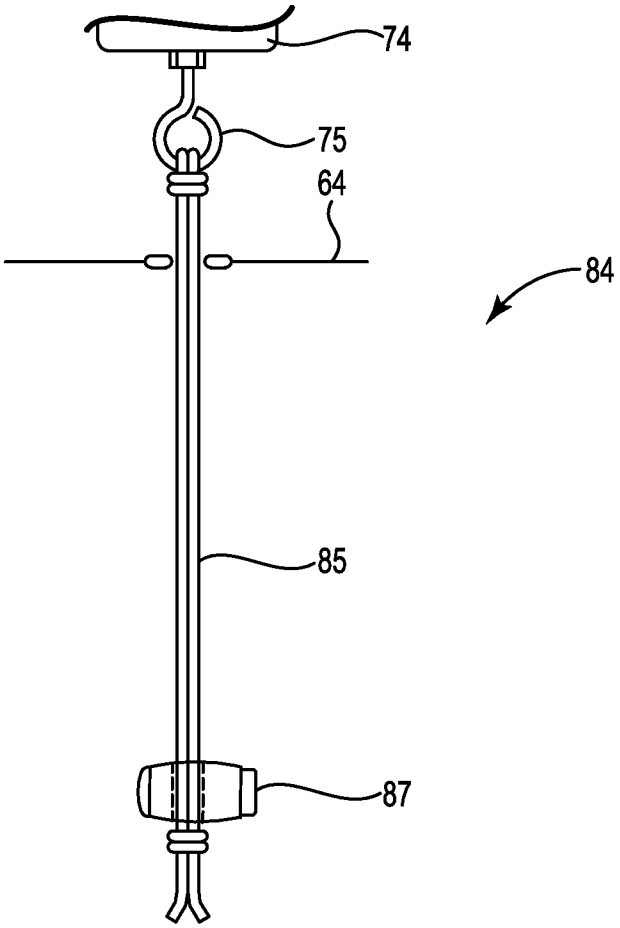
FIG. 3B is a perspective view of a roof tether utilized to collapse the roof in accordance with the invention.
Figure 3C:
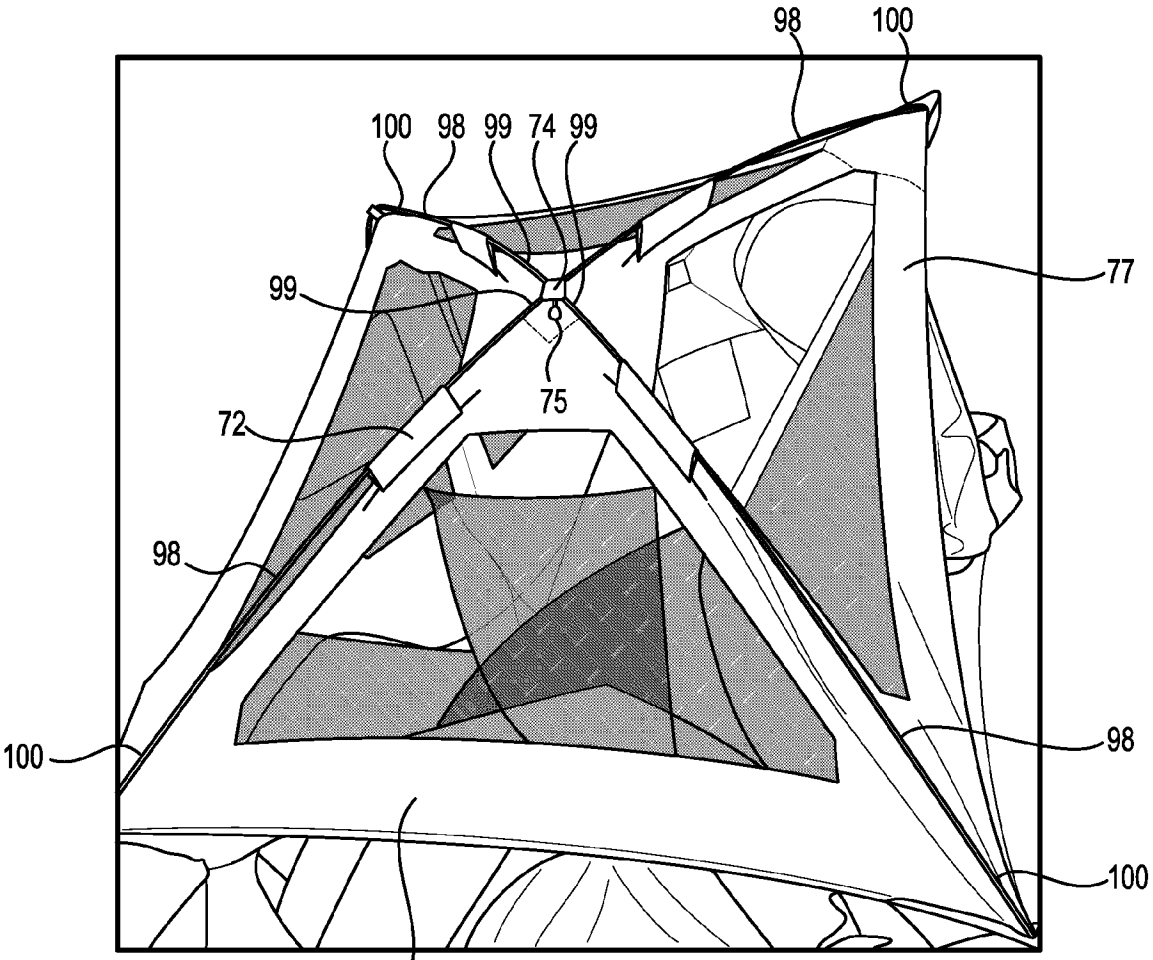
FIG. 3C depicts the roof panel with the attachment of the roof poles to the roof hub and roof sleeves in accordance with the invention.
Figure 3D:
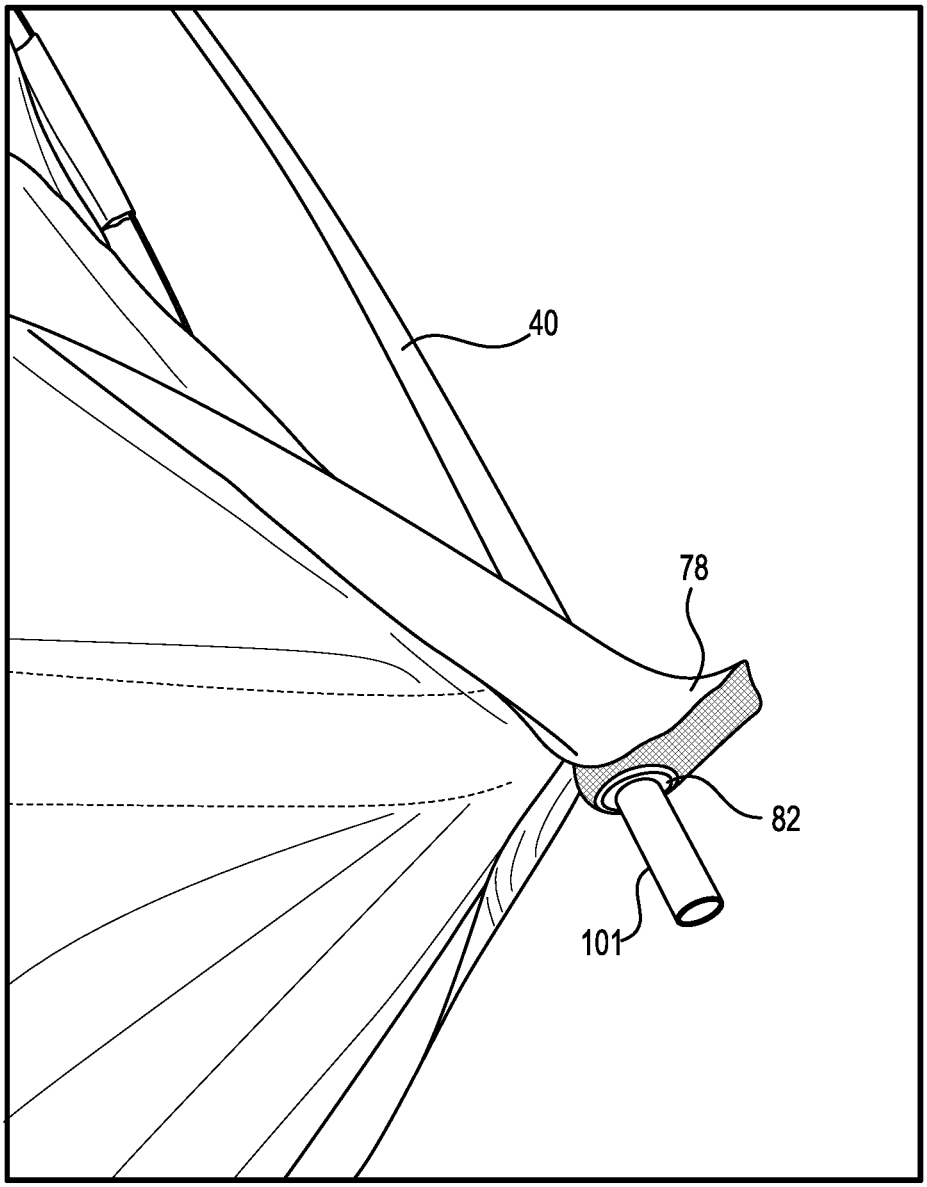
FIG. 3D depicts a roof pole/female coupling piece inserted through a corner metal grommet of the roof.
Figure 4:
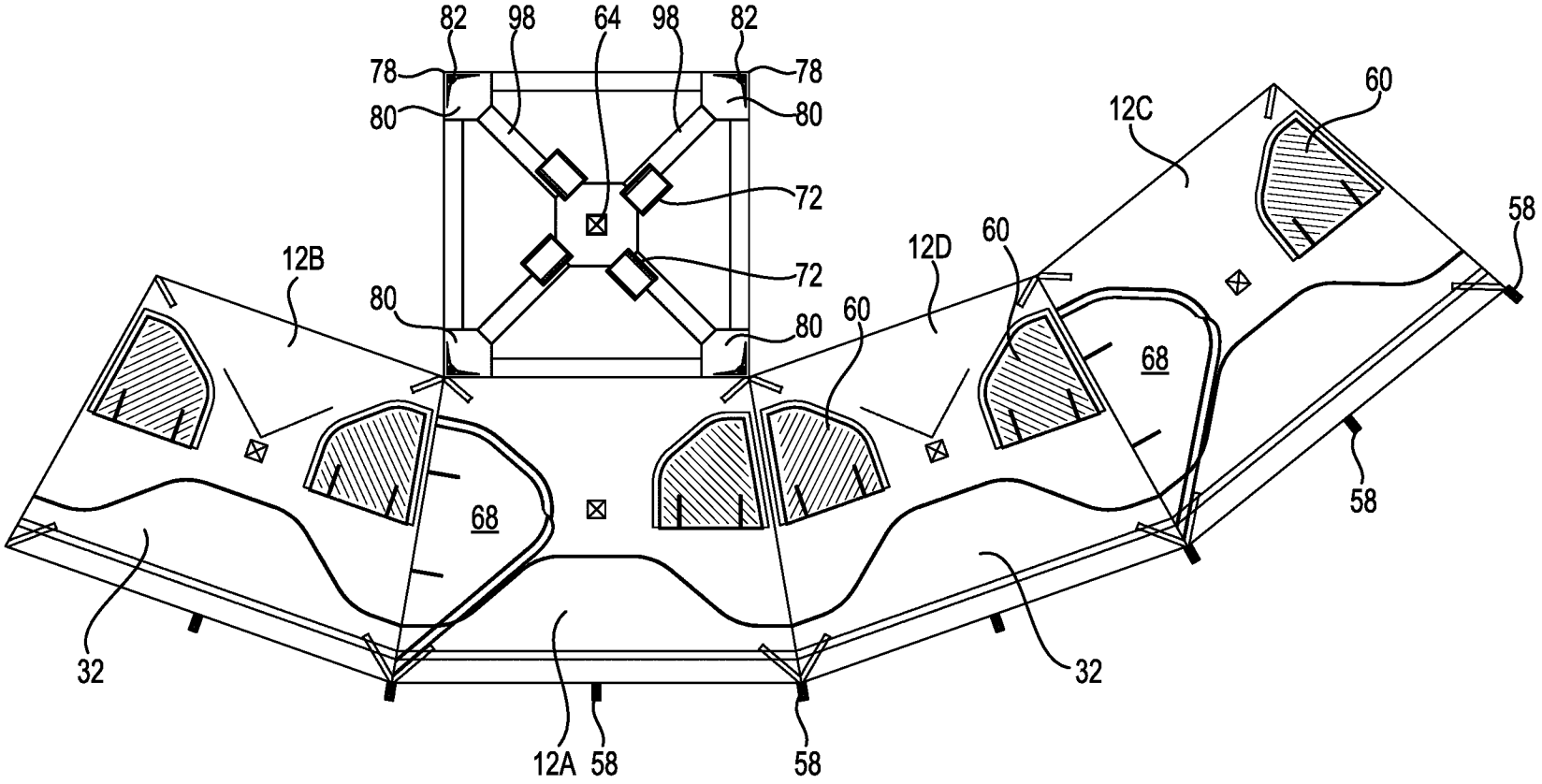
FIG. 4 is a flattened exterior view of the roof and side wall panels of the tent in accordance with the invention.

Referring generally now to FIGS. 3A-3D the roof 16 of the collapsible tent 10 will now be described. As best seen in FIG. 3C, roof 16 may include four roof panels 77 sewn or attached together. Roof panels 77 may include screening, which allows for air circulation in the tent 10. Roof 16 also includes a roof patch hub 64 similar to side wall patch hub 38 both in construct and function and may be positioned centrally on the exterior 76 of roof 16. Each of the four corners 78 of roof panel 16 includes a fabric corner pocket 80 on the exterior surface 76 thereof. Fabric corner pocket 80 also includes metal grommet 82, as best seen in FIGS. 3A and 3D. Metal grommet 82 includes a hole therethrough that is configured to receive a connecting piece 101 of roof poles 98 as hereinafter will be described.

Roof 16 includes four flexible roof poles 98 with a first roof pole end 99 and second roof pole end 100. First end 99 of roof pole 98 is received through roof sleeve 72 and attached to roof hub 74, as best seen in FIG. 3C. Centrally-positioned roof hub 74 is similar if not identical to side wall hub 39 on side walls 12 and is constructed of plastic or metal and includes a socket joint 31 for receiving the ball 41 of first end 99 (See FIG. 2H). A metal or plastic plate 200 (see FIG. 2I) secures the first ends 99 therewithin. After the initial set up, roof poles 98 are configured to be permanently attached to roof hub 74. By "permanently attached" the inventor means that in operation, i.e. after it leaves the factory, the roof poles 98 "remain with" and are secured in place by the metal or plastic plate 200. Those of skill in the art will appreciate, however, that the metal or plastic plate 200 may be removed and one or more of the poles 98 may be removed to be replaced if damaged or otherwise need service. Second end 100 of roof pole 98 comprises a female coupling piece 101, best seen in FIG. 7, that is received through hole in metal grommet 82 and is exposed, as best seen in FIG. 3E, for reasons hereinafter described. In operation after the rainfly leaves the factory, female coupling piece 101 is configured to remain with roof pole 98 and roof panel 16 for ease of assembly. However, the female coupling piece 101 may be disassembled from the roof pole 98 if it needs to be replaced or service. Roof sleeves 72 may be configured to wrap around roof poles 98 to further secure roof poles 98 to roof 16 when roof is in the extended or "pop-out" position.

Roof 16 includes roof tether 84 as best seen in FIG. 3B. Roof tether 84 is positioned on the interior of roof 16 through the patch hub 64 and couples to eye portion 75. Eye portion 75 in turn is coupled to roof hub 74. Roof tether 84 broadly includes a hand-graspable pull 85 and toggle 87. Roof tether 84 has the opposite function to that of hand-graspable pull 42. When "popping out" the side wall panels during assembly, it is easy to grab the hand-graspable pull 42 from outside the tent and "pop" out the side walls 12. However, when disassembling the tent at the end of the camping trip and all side panels have been "popped in," the roof hub 74 cannot easily be accessed from the exterior of the tent. Therefore, roof tether 84 may be easily accessed and pulled from inside tent 10 to first collapse the roof 16 during disassembly or to collapse the roof 16 to make it easier to attach optional rainfly 86 when needed. When the roof is "popped out" the bending in poles 98 cause the roof hub 74 to become elevated above the roof 16 and because poles 98 are attached to sleeves 72 and "fixedly" coupled to roof hub 74 the tension causes the entire roof to remain in an elevated positioned.

Figure 5A:
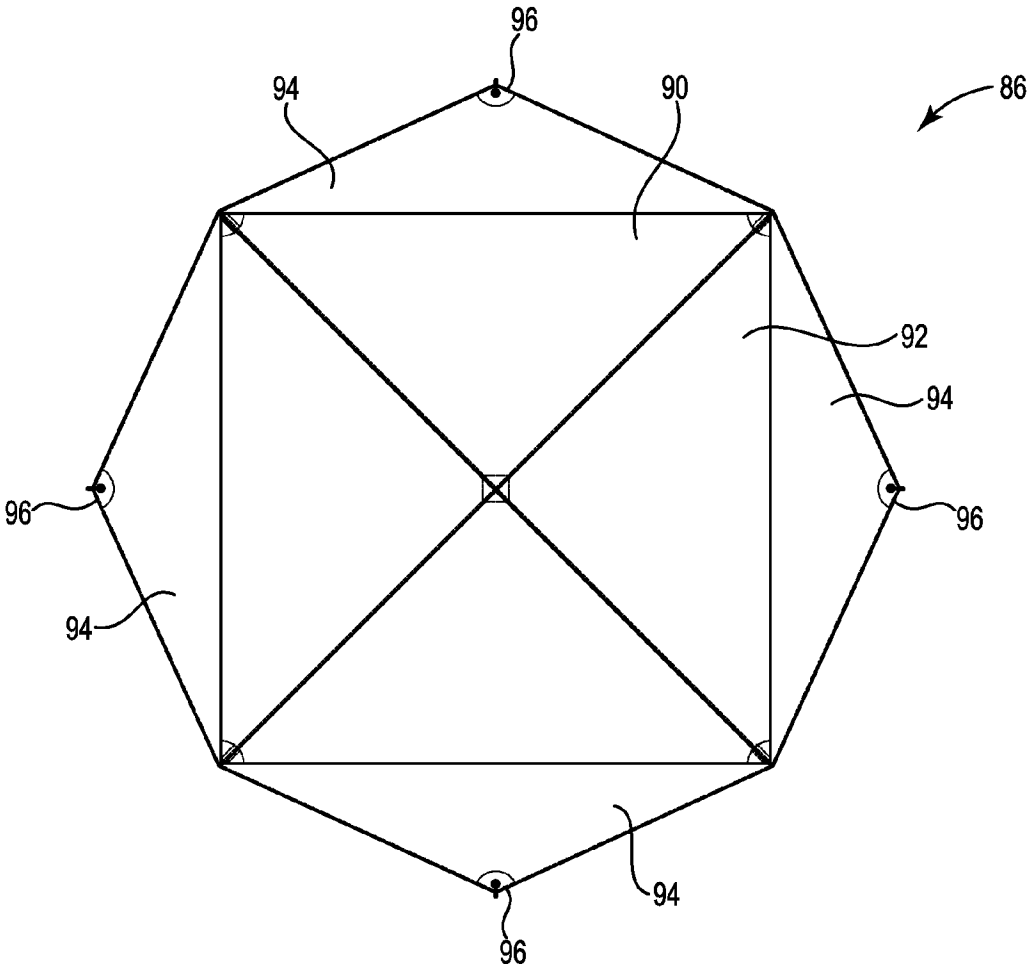
FIG. 5A is a top view of the exterior of the optional rainfly in accordance with the invention.
Figure 5B:
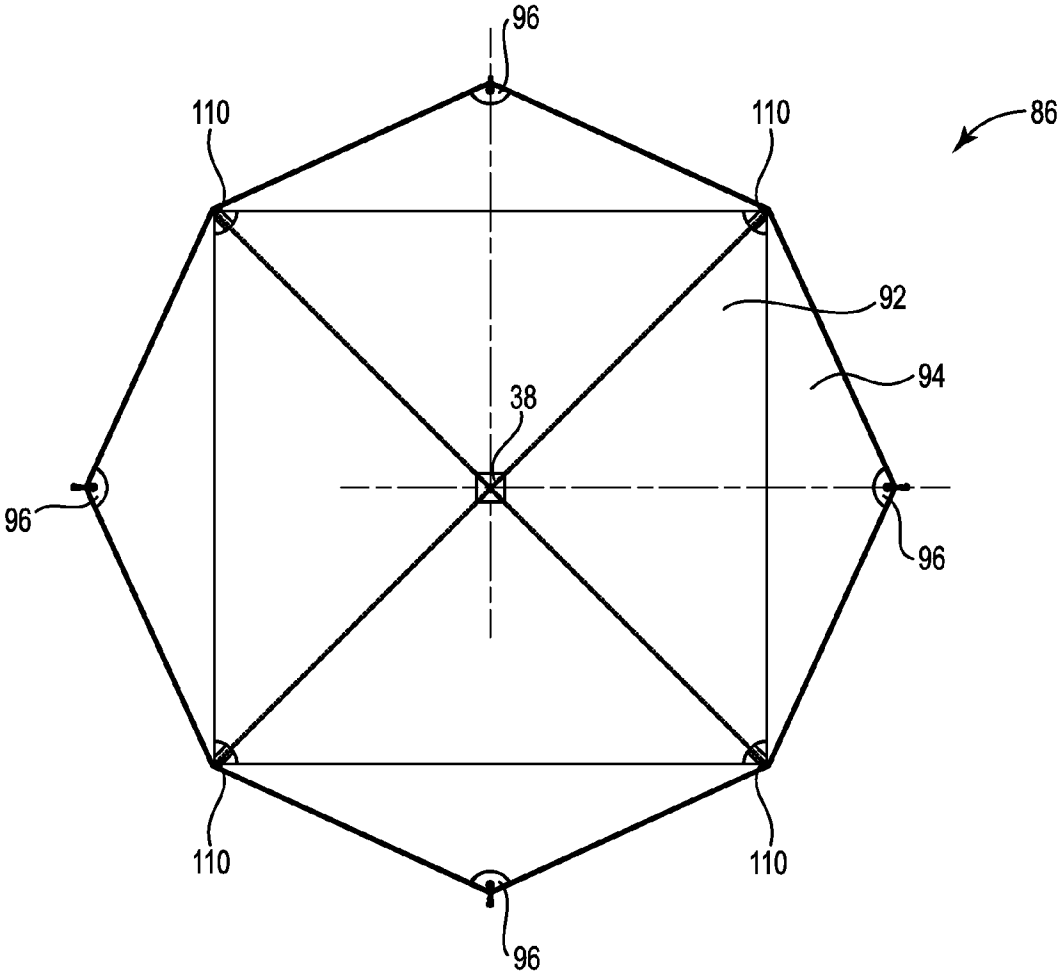
FIG. 5B is a top view of the interior of the rainfly.
Figure 5C:
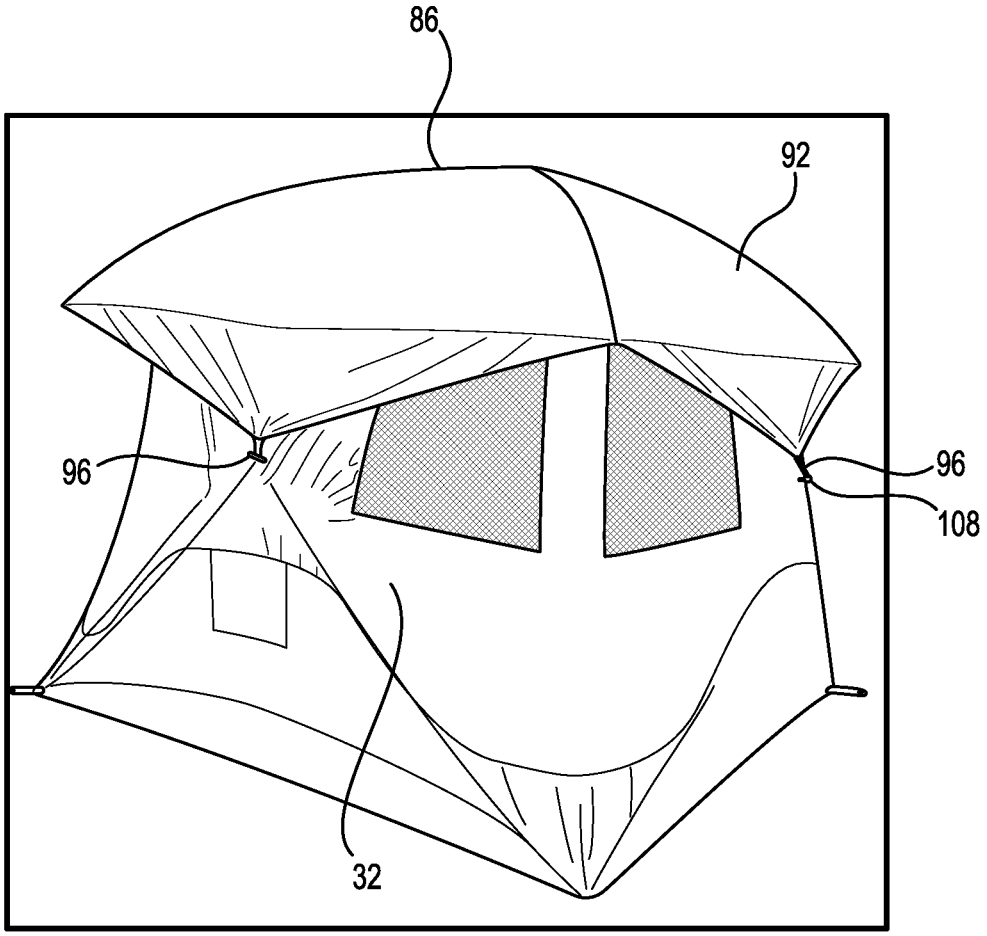
FIG. 5C depicts the attachment of the rainfly to the tent side walls via the hook and eyebolt mechanism of FIG. 6C.
Figure 6A:
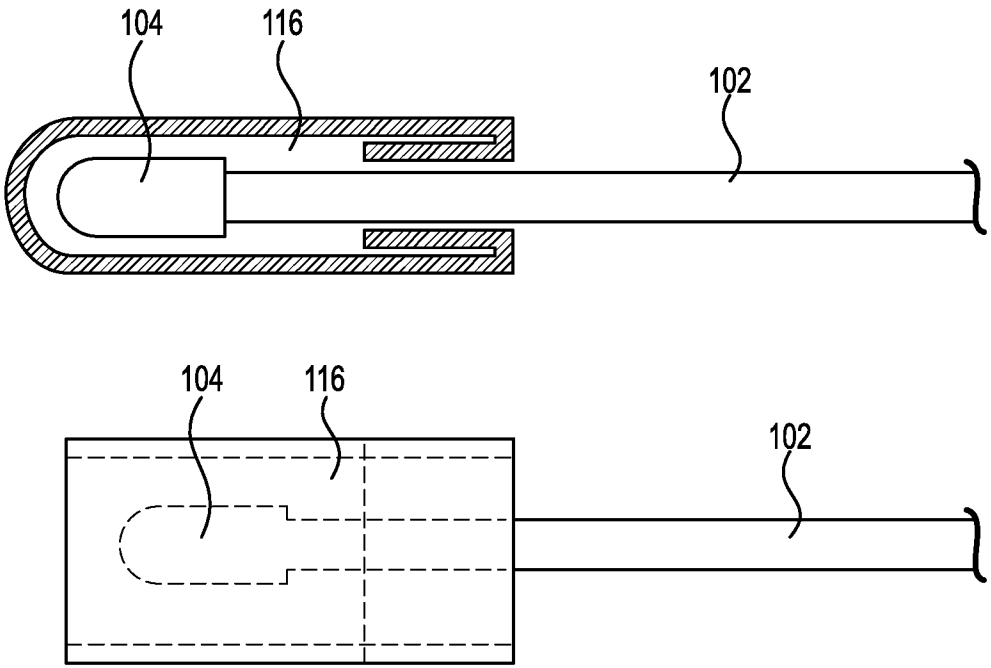
FIGS. 6A-6C depict various component parts of the tent in accordance with the invention.
Figure 6B:
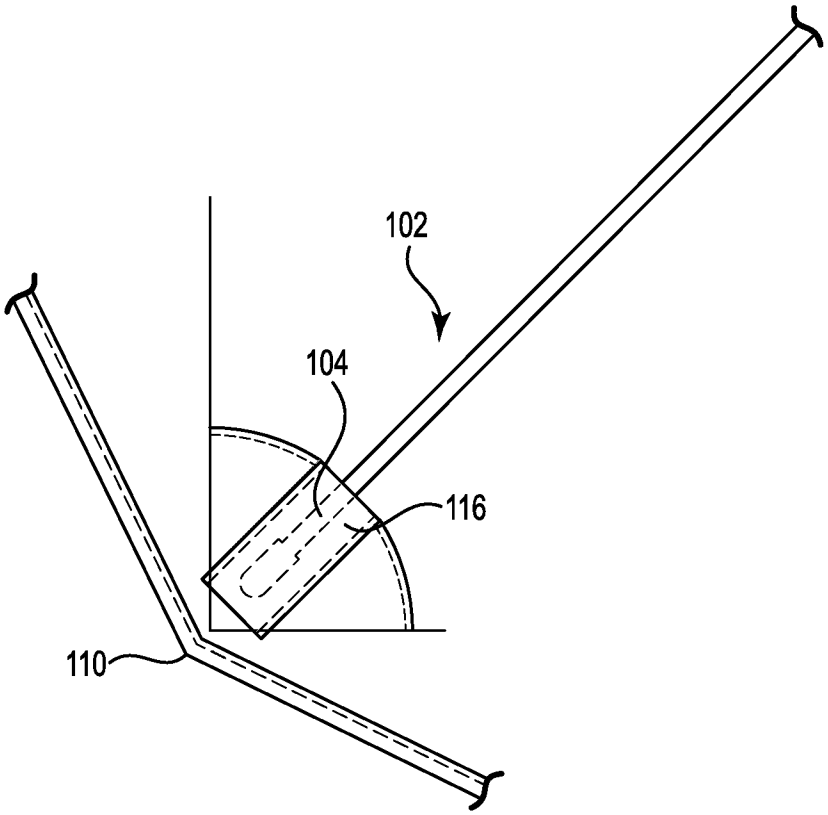
Figure 6C:
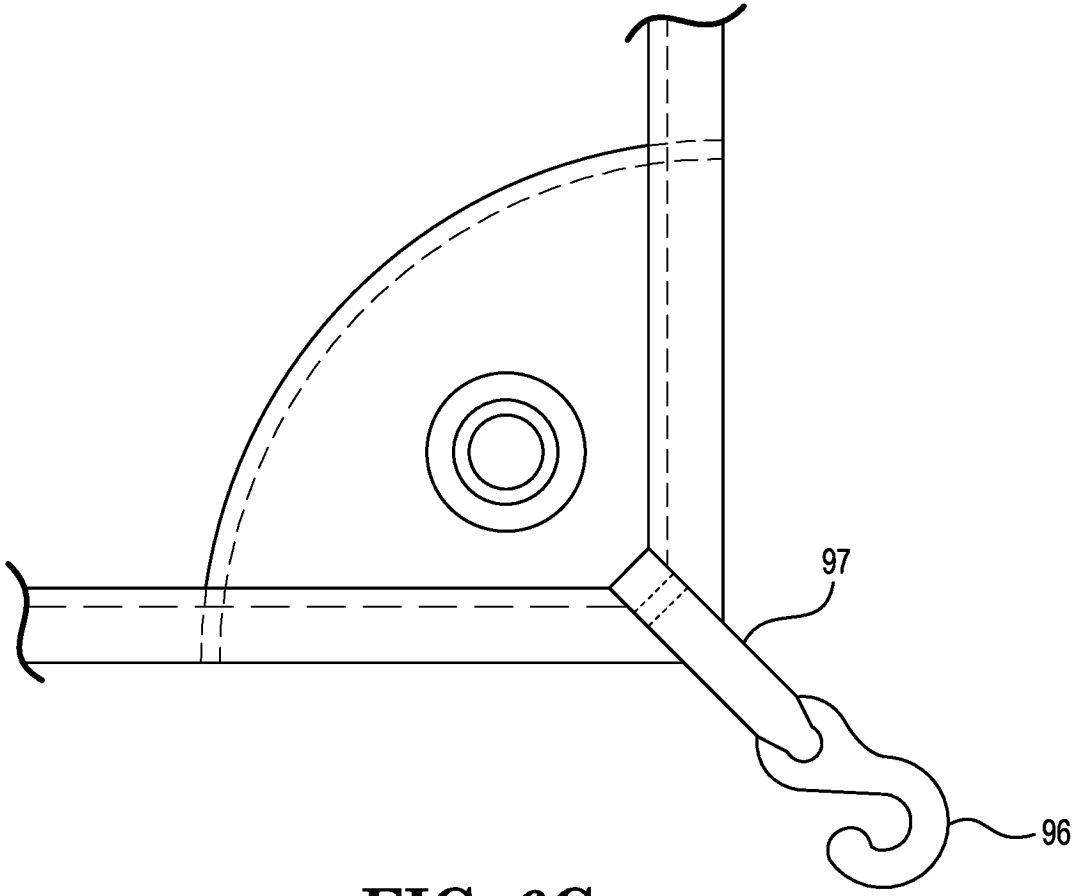
Figure 7:
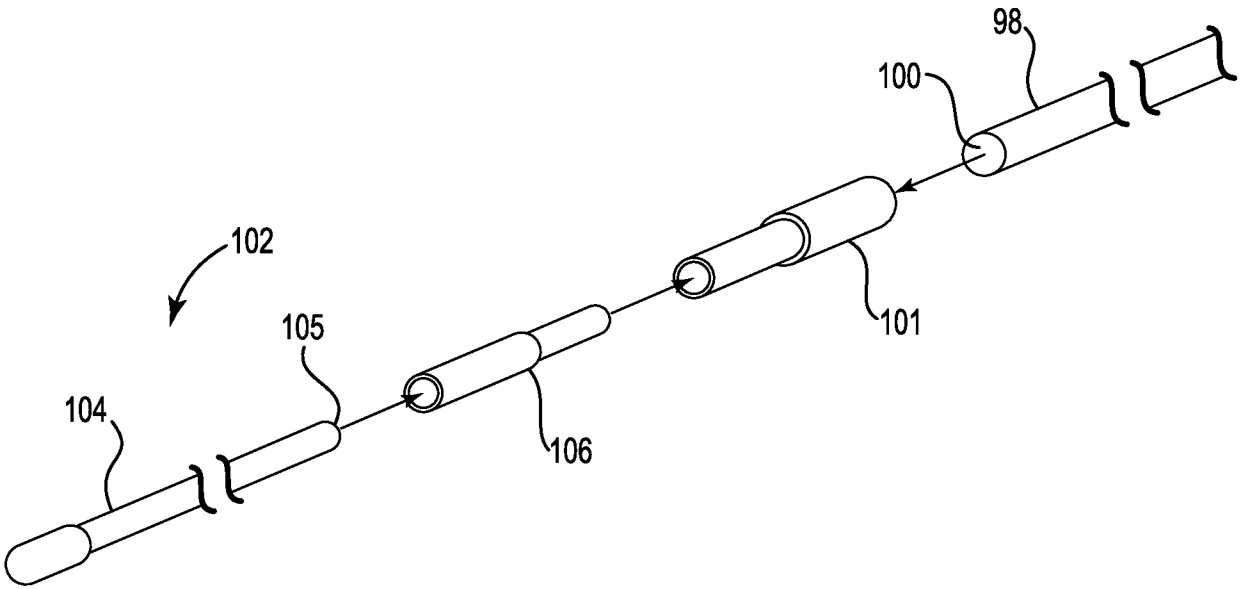
FIG. 7 illustrates the attachment mechanism of the rainfly to the tent in particular the connecting piece of the rainfly coupling with the roof pole connecting piece.

Referring now to FIGS. 5-7 the rainfly 86 will now be discussed. If the roof 16 is in the expanded position, the rainfly 86 may be attached to the roof 16 by pulling downwardly on roof tether 84 to collapse the roof 16.

Rainfly 86 includes interior surface 88 (FIG. 5B), exterior surface 90 (FIG. 5A), central portion 92, overhang 94 and four rainfly connecting pieces 102 (FIG. 7) configured to couple rainfly 86 to the female coupling piece 101 coupled to the second end 100 of roof poles 98. Overhang 94 is triangular in shape and includes hook 96 as best seen in FIG. 6C. Hook 96 is coupled to the overhang 94 by strap 97. Strap 97 may be expandable and constructed of elasticized material but strap 97 may also be constructed of non-elasticized materials. Hook 96 couples with eyebolt 108 positioned on the exterior of side wall panel 32, as best seen in FIG. 5C. Rainfly connecting piece 102, as best seen in FIG. 7, includes first end 104, second end 105 and male coupling piece 106.

The inside of each corner 110 of rainfly includes a pocket or sleeve 116 into which the first end 104 of rainfly connecting piece 102 is inserted as best seen in FIG. 6B. FIG. 7 is an exploded view of the rainfly connecting piece 102 and the roof pole 98. Second end 105 of rainfly connecting piece 102 couples with male coupling piece 106. Male coupling piece 106 comprises a crimped metal sleeve that is permanently attached to the second end 105 of rainfly connecting piece 102. Those of skill in the art will appreciate that male coupling piece 106 operably couples with female coupling piece 101. Those of skill in the art will appreciate that the male 106 and female 101 coupling pieces may also be removably attached to the ends 105, 100 of the rainfly connecting piece 102 and roof pole 98, respectively. However, to reduce the number of pieces a user must deal with in the field they are designed to be permanently attached. In the field, a user couples the rainfly 86 to roof 16 by inserting the male coupling piece 106 into the female coupling piece 101 of roof pole 98. The rainfly 86 is draped over the roof panel 16 as the remaining male coupling pieces 106 of rainfly connecting pieces 102 are coupled to the remaining female coupling pieces 101 of roof poles 98. After all rainfly connecting pieces 102 are coupled to roof poles 98 a user then "pops" out the roof panel 16 manually by pushing it upwardly from inside the tent 10.

Those of skill in the art will appreciate that male coupling piece 106 could be made as an integral part of rainfly connecting piece 102. However, due to the nature of the plastic/fiberglass construct of rainfly connecting piece 102 and roof poles 98, male 106 and female 101 coupling pieces are constructed of metal to prevent the shredding and wear and tear of rainfly connecting piece 102 and roof poles 98 when assembling and disassembling the rainfly to the tent. Those of skill in the art will also appreciate that the male 106 and female 101 coupling pieces may be reversed as female and male coupling pieces.

In operation, an individual pulls on hand-graspable pull 42 on each side wall 12, which acts to bend side wall poles 40 and forces side wall poles 40 towards the corners of patch hub 38 and the corners of upper or lower sleeve 48, 50 as the case may be. The bending of the side wall poles 40 creates tension in the side wall panels 32. Roof 16 is expanded from the inside of the tent 10 by pushing the roof 16 upwardly. The tent 10 is then attached to floor 14 by marrying fastening materials 30, 64 together. Commercially available stakes may be used to anchor tent to the ground via straps 58. Rainfly 86 may optionally be attached as hereinbefore disclosed.

Although the present invention has been described with reference to certain aspects and embodiments, those of ordinary skill in the art will appreciate that changes may be made in form and detail without departing from the spirit and scope of the invention.

What is claimed is:

1. A collapsible shelter comprising:

a floor having a recessed portion and an elevated portion, said elevated portion including first means for fastening thereon;

four side walls including second means for fastening configured to removably couple each of said side walls to said floor by said first means for fastening, each of said side walls including a first plurality of flexible poles operably coupled thereto and configured to expand said side walls outwardly; and a roof including a plurality of roof panels, each of said panels coupled to one of said side walls, each of said roof panels including an outwardly extending sleeve on an exterior surface thereof, said sleeve configured to receive a second plurality of flexible poles on said exterior surface each of said second plurality of flexible poles having first and second ends, said second end operably coupled to a corner of said roof panel and operably pivotally coupled at the first end to said roof panel, said second plurality of flexible poles configured to expand said roof outwardly.

2. The collapsible shelter of claim 1 wherein said second end of said second plurality of flexible poles each include a coupling piece constructed of a different material than said second plurality of flexible poles.

3. The collapsible shelter of claim 2 further comprising a rainfly having four corners, said four corners each housing a rainfly connecting piece configured to matingly and removably attach said rainfly to the coupling piece of said second plurality of flexible poles.

4. The collapsible shelter of claim 3 wherein said rainfly connecting piece includes a coupling end that is constructed of a different material than the rainfly connecting piece.

5. The collapsible shelter of claim 3 wherein said rainfly includes an overhang having a plurality of means for securing said overhang to each of said side walls.

6. The collapsible shelter of claim 2 wherein said coupling piece is configured to be permanently attached to the second end of said second plurality of flexible poles.

7. The collapsible shelter of claim 1 wherein said roof panels including screening in said roof panels.

8. The collapsible shelter of claim 1 wherein said floor further includes a plurality of ties structured to further couple floor to said plurality of side walls.

9. The collapsible shelter of claim 1 wherein said first means for fastening is positioned along an upper edge of said elevated portion.

10. The collapsible shelter of claim 1 wherein said first and second plurality of flexible poles are constructed of fiberglass.

11. The collapsible shelter of claim 1 wherein a hand-graspable pull is positioned on an exterior of each of said side panels and configured to allow a user to pull said first plurality of flexible poles outwardly.

12. The collapsible shelter of claim 1 wherein each side panel includes a ball and socket joint for pivotally receiving a first end of said first plurality of flexible poles.

13. The collapsible shelter of claim 1 wherein at least one of said side panels includes screening thereon.

14. The collapsible shelter of claim 1 wherein said roof includes a roof tether that is operably coupled to an interior surface of said roof and is configured to allow a user to collapse said roof.

15. The collapsible shelter of claim 1 wherein said roof includes a roof hub that fixedly attaches said second plurality of flexible poles to said roof.

16. The collapsible shelter of claim 1 wherein said first and second means for fastening are constructed from hook and loop material.

* * * * *